United States Patent [19]

Corella

[11] Patent Number: 4,696,404

[45] Date of Patent: Sep. 29, 1987

[54] HEAT SEALED PACKAGE WITH PERFORATED COMPARTMENT SEAL

[76] Inventor: Arthur P. Corella, 8166 Vanscoy Ave., North Hollywood, Calif. 91602

[21] Appl. No.: 900,748

[22] Filed: Aug. 27, 1986

[51] Int. Cl.[4] ..... B65D 65/30

[52] U.S. Cl. ..... 206/604; 206/632; 206/633; 383/94

[58] Field of Search ..... 206/604, 601, 605, 607, 206/609, 610, 627, 632, 628, 633, 634; 229/80, 81; 383/42, 94, 107, 102, 103

[56] References Cited

U.S. PATENT DOCUMENTS

| | | | |
|---|---|---|---|
| 2,962,158 | 11/1960 | Struthers | 383/94 |
| 3,156,355 | 11/1964 | Rodgers | 206/604 |
| 3,419,137 | 12/1968 | Walck, III | 206/632 |
| 3,913,789 | 10/1975 | Miller | 206/601 |
| 3,937,396 | 2/1976 | Schneider | 383/94 |
| 4,310,118 | 1/1982 | Kisida et al. | 383/103 |

FOREIGN PATENT DOCUMENTS

| | | | |
|---|---|---|---|
| 690614 | 4/1953 | United Kingdom | 206/604 |

*Primary Examiner*—Willis Little

*Attorney, Agent, or Firm*—Donald Diamond

[57] ABSTRACT

A peripherally sealed dispensing package is provided that includes:

a compartment with opposing walls;

an inner seal disposed within the compartment and sealingly engaging an oppositely aligned portion of the opposing walls; and a finger traversable aperture extending through the inner seal to facilitate the opening of the package.

15 Claims, 6 Drawing Figures

HEAT SEALED PACKAGE WITH PERFORATED COMPARTMENT SEAL

BACKGROUND OF THE INVENTION

This invention relates to dispensing packages and, more particularly, to peripherally sealed dispensing packages that are provided with an inner compartmental seal which incorporates an aperture to facilitate the opening of such packages.

The packaging of liquid and dry products in heat sealable, dispensing enclosures by high-speed production techniques and equipment is a well-developed art. The heat sealed, packaged product is generally referred to as having a form-fill-seal construction and is sometimes characterized as a form and fill package. These packages may have a rectangular pouch configuration or other special shape and construction. As to the pouch configuration, there are three basic forms, which are known as the pillow type, three-side seal and four-side seal. The pillow type is constructed from one web and is provided with top and bottom seals and a vertical seam which can take the form of a fin seal or a lap seal. The three-side seal is constructed from one web and is provided with a bottom fold and top and side seals. The four-side seal is constructed from one or two webs and is provided with bottom, side and top seals.

The web used in the construction of heat sealable packages can take the form of a single layer or a multilayer laminate. In either form, the oppositely disposed sealable faces comprise heat sealable thermoplastic material such as polyethylene, polypropylene or the like. In the laminate configuration, the inner layer is, for example, polyethylene and the outer layer can be cellophane, paper, polyester, metalized polyester, aluminum foil or the like. A heat sealable laminate comprising three or more layers is sometimes designated as a laminate having a sandwich construction or configuration.

The use of moderately thick thermoplastic film as heat sealable packaging material and the use of materials such as linear low density polyethylene and high-strength polyester in the preparation of heat sealable laminates has resulted in packages made therefrom having improved sealing and barrier characteristics. However, these materials which provide beneficial packaging characteristics also increase the manual tear-open resistance of such packages. This tear-open resistance is accentuated when the hands and particularly, the fingers, are wet or oily. Heretofore, tear resistant packaging was provided with a starter tear cut in the peripheral seal, in the form of a slot or notch, to act as guidance means for tearing open the heat sealed package. Since the starter tear cut is produced with a hot knife or blade, the resulting slot or notch has a tendency to re-seal itself. In addition, the utility of the starter cut as a tear-open mechanism is limited by the width of the peripheral seal which determines the depth of the cut. Also, the starter tear cut in tear resistant packages does not substantially improve the tear-open capability of such packages when the fingers are wet or oily.

In order to facilitate the tear-open capability of heat sealed packages having increased tear-open resistance, it would be advantageous to incorporate into such packages finger gripping means which traverse the package compartment or pouch without imparting the integrity of the package and which permit a tear-open force to be applied to the package that is not adversely affected by wet or oily fingers.

SUMMARY OF THE INVENTION

In accordance with this invention, there is provided a peripherally sealed dispensing package that includes a compartment with opposing walls; an inner seal disposed within the compartment and sealingly engaging an oppositely aligned portion of the opposing walls; and an aperture extending through the inner seal to facilitate the opening of the package.

The inner seal is advantageously positioned adjacent to the peripheral seal and can be spaced from or bridged to the peripheral seal. The area of the inner seal and the size of the aperture extending therethrough are so selected as to permit finger gripping traversal. The opposing walls of the dispensing package include inner faces of heat sealable material as, for example, polyethylene and outer faces, with the inner faces being heat sealed within the area of the peripheral seal and within the area of the inner seal. The outer face of one or both of the opposing walls can comprise cellophane, paper, plastic such as polyester, metalized plastic or aluminum foil, with the selection of the sheet or laminate and the thickness thereof being based on the nature of the goods to be packaged. The package, comprising opposing walls, can be constructed from a pair of super-imposed sheets, from a single sheet folded in a manner to provide a pair of super-imposed sheets, and from a single sheet circumscribed in a manner to provide a pillow configuration.

DETAILED DESCRIPTION

Figure 1:
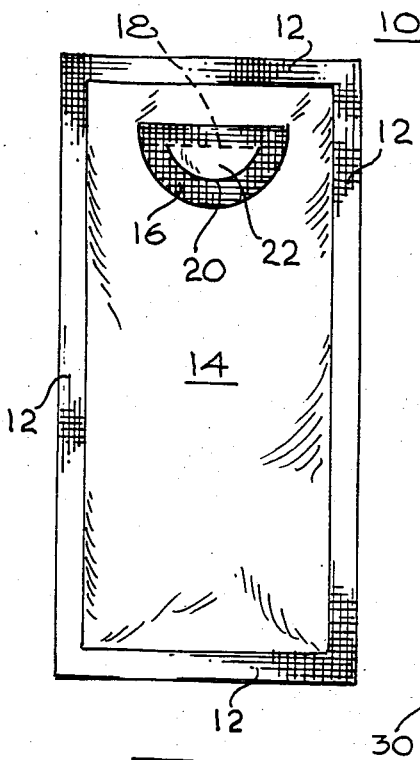
FIG. 1 is a front elevational view of a peripherally sealed package which incorporates an inner seal that is provided with a flap-type transverse aperture.

Referring now to the drawings, and, in particular, to FIG. 1, there is shown a heat-sealed package 10 in the form of a four-side seal having front and back opposing walls provided with top, bottom and side peripheral seals 12 which define a compartment or pouch 14. The heat-sealed package has a form-fill-seal construction wherein opposing, heat sealable webs are provided with side and bottom peripheral seals to form a compartment for receiving and holding a dispensable product and thereafter the package is completed by providing the compartment with a top peripheral seal.

Figure 2:
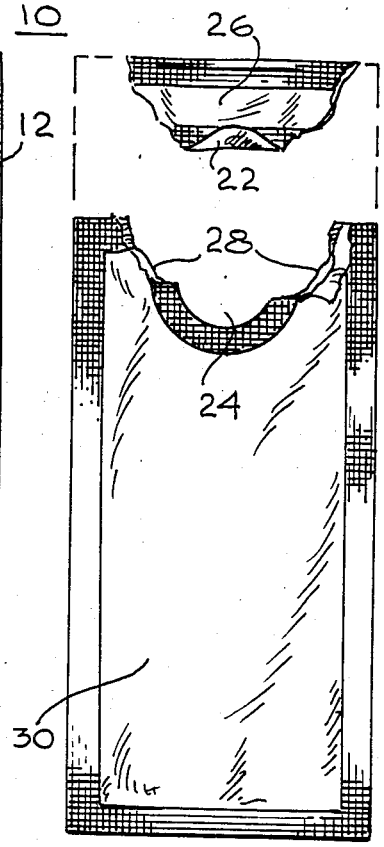
FIG. 2 depicts the peripherally sealed package of FIG. 1 with the top portion of the package being torn through the inner seal and separated from the main body of the package so as to provide egress means for dispensing contents from the compartment or pouch.

In order to facilitate the opening of the package, the compartment 14 is provided with an inner seal 16 which incorporates a pivotally disposed 18, die-cut 20, swing-out flap 22 that defines a finger traversing aperture 24, as shown in FIG. 2. The inner seal is advantageously positioned near the top seal. The sealing mechanism for preparing the inner seal can be included in the top sealing platen, in which event the top seal and inner seal are formed in one step, or a separate sealing platen can be utilized to form the inner seal. The die-cut 20, which forms the swing-out flap 22, is preferably made after the package is completed, but, if desired, the die-cut can be made substantially simultaneously with the formation of the inner seal.

To open the heat-sealed package described herein, one hand is used to grip the package and one finger from the other hand is passed through the aperture of the inner seal whereupon a pull-apart force is applied to the package to remove an upper segment 26 of the package so as to provide one or more openings 28 for dispensing contents from the main body 30 of the package, as shown in FIG. 2.

Figure 3:
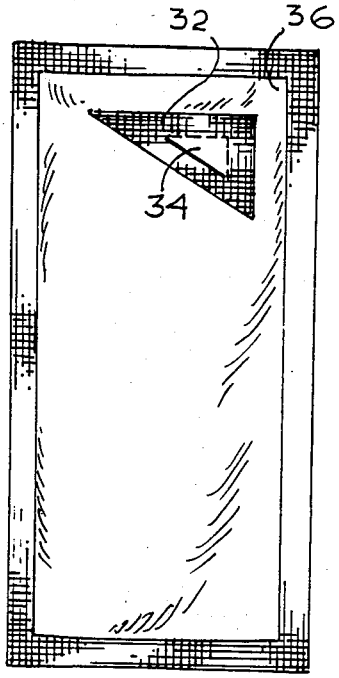
FIG. 3 is a front elevational view of a peripherally sealed, rectangular package which incorporates, at a corner, an inner seal that is provided with a flap-type transverse aperture.
Figure 4:
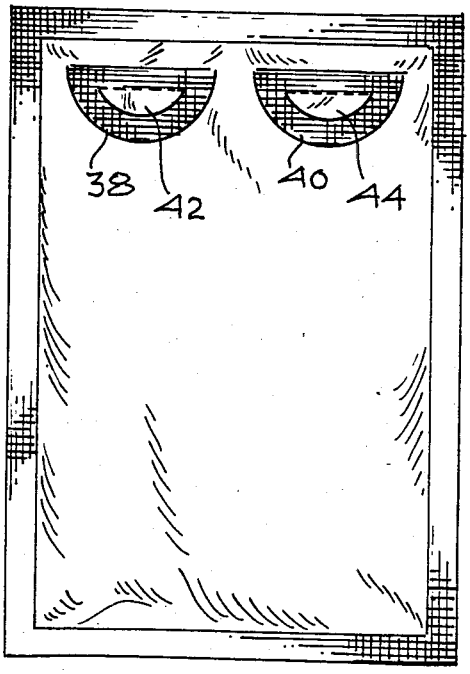
FIG. 4 is a front elevational view of a peripherally sealed package which incorporates two adjacent inner seals that are provided with flap-type transverse apertures.
Figure 5:
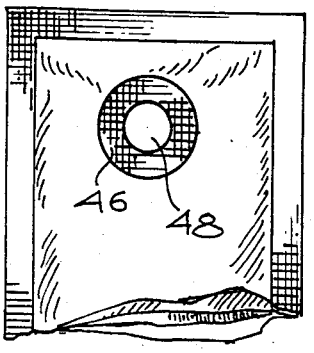
FIG. 5 is a fragmentary, front elevational view of a peripherally sealed package which incorporates an inner seal that is provided with a transverse aperture.
Figure 6:
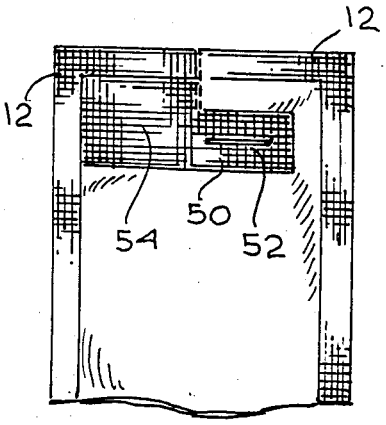
FIG. 6 is a fragmentary, front elevational view of a peripherally sealed package which incorporates a perforated inner seal that is sealingly bridged to the peripheral seal.

Other embodiments of this invention are shown in FIGS. 3–6. In FIG. 3, the inner seal 32 and its swing-out flap 34 have a triangular configuration and this seal is triangularly aligned at a corner 36 of the package. In FIG. 4, the package is provided with first and second semi-circular inner seals 38, 40 having first and second semi-circular swing-out flaps, respectively, 42, 44. In FIG. 5, the package is provided with a circular inner seal 46 having a circular, finger traversing aperture 48. In FIG. 6, the package is provided with an inner seal 50 having a slit-type finger traversing aperture 52 and a portion of the inner seal is sealingly bridged 54 to the peripheral seal 12.

The tear-open structure of this invention can be incorporated into heat-sealed packages of diverse configuration and construction including the four-side seal, the three-side seal and the pillow type. It is particularly well suited for incorporation into heat-sealed packages containing fluidic products such as hair and other body-care preparations, food dressings and the like. Since these packages are frequently opened under conditions where the hands are wet or oily, the presence of the perforated inner seal in the package compartment permits finger gripping traversal of the package to thereby facilitate the opening of such packages. This feature is particularly advantageous where the heat-sealed package is constructed from a high-strength laminate such as a polyethylene/polyester laminate, since such packages are particularly difficult to tear open when the hands are wet or oily.

While in the foregoing description and accompanying drawings there has been shown and described the preferred embodiment of this invention, it will be understood, of course, that minor changes may be made in the details of construction as well as in the combination, arrangement, and composition of parts, without departing from the spirit and scope of the invention as claimed.

That which is claimed is:

1. In a peripherally sealed dispensing package that includes a compartment with opposing walls, the improvement which comprises:

an inner seal disposed within said compartment and sealingly engaging an oppositely aligned portion of said opposing walls; and a finger traversable and gripable aperture extending through said inner seal, said aperture defining a finger pull for tearing open said sealed package to permit dispensing of the package contents.

2. The dispensing package of claim 1 wherein the inner seal is proximate to the peripheral seal.

3. The dispensing package of claim 1 wherein the inner seal is in spaced relationship to the peripheral seal.

4. The dispensing package of claim 1 wherein the inner seal is bridged to the peripheral seal.

5. The dispensing package of claim 1 wherein said opposing walls include interfaces of heat sealable material and outer faces, with said interfaces being heat sealed within the area of the peripheral seal and within the area of the inner seal.

6. The dispensing package of claim 5 wherein the outerface of at least one of said walls comprises cellophane, paper, plastic, metalized plastic or aluminum foil.

7. The dispensing package of claim 1 wherein the opposing walls comprise a pair of superimposed sheets.

8. The dispensing package of claim 1 wherein the opposing walls comprise a single sheet folded in a manner to provide a pair of superimposed sheets.

9. The dispensing package of claim 1 wherein the opposing walls comprise a single sheet circumscribed in a manner to provide a pillow configuration.

10. The dispensing package of claim 1 wherein the aperture is defined by a swing-out flap.

11. The dispensing package of claim 1 wherein the aperture is defined by a slit.

12. The dispensing package of claim 1 wherein the aperture is defined by an annular configuration.

13. The dispensing package of claim 1 wherein the aperture is defined by a semi-annular configuration.

14. The dispensing package of claim 1 wherein the aperture is defined by a triangular configuration.

15. The dispensing package of claim 1 wherein first and second inner seals incorporating first and second finger traversable and gripable apertures, respectively, are disposed in substantially side-by-side relationship in said compartment.

* * * * *